US006565312B1

(12) United States Patent
Horn et al.

(10) Patent No.: US 6,565,312 B1
(45) Date of Patent: May 20, 2003

(54) FLUID-COOLED TURBINE BLADES

(75) Inventors: Mark D. Horn, Granada Hills, CA (US); James Lobitz, Oak Park, CA (US); David R. Matthews, Simi Valley, CA (US); Luis A. Rosales, Moorpark, CA (US); Kenneth M. Sprouse, Northridge, CA (US); Allan Von Arx, Northridge, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/029,451

(22) Filed: Dec. 19, 2001

(51) Int. Cl.[7] ..... F01D 5/18; F01D 9/06

(52) U.S. Cl. ..... 415/115; 415/114; 415/116; 416/96 R; 416/97 R

(58) Field of Search ..... 415/114, 115, 415/116; 416/92, 96 R, 96 A, 97 R

(56) References Cited

U.S. PATENT DOCUMENTS 2,648,520 A * 8/1953 Schmitt ..... 416/92
3,468,513 A * 9/1969 Schmitz ..... 416/97 R
3,619,076 A * 11/1971 Kydd ..... 415/115
3,848,307 A * 11/1974 Kydd ..... 415/115
3,967,353 A * 7/1976 Pagnota et al. ..... 416/96 R
4,179,240 A 12/1979 Kothmann
4,190,398 A 2/1980 Corsmeier et al.
4,330,235 A 5/1982 Araki
4,629,397 A * 12/1986 Schweitzer ..... 416/96 R
6,195,979 B1 3/2001 Fukuyama

FOREIGN PATENT DOCUMENTS

GB 2084262 A * 4/1982 ..... 416/92

* cited by examiner

*Primary Examiner*—Christopher Verdier
(74) *Attorney, Agent, or Firm*—Alston & Bird LLP

(57) ABSTRACT

A cooled turbine blade (either a rotor blade or a stationary vane) comprises a blade structural member whose primary function is to withstand the various loads exerted on the blade and maintain structural integrity of the blade, and a heat-transfer sheath that surrounds the outer surface of the structural member. A plurality of coolant passages are formed between the structural member and the heat-transfer sheath. Thus, when coolant is passed through the coolant passages, the heat transferred to the sheath from the hot gases passing through the turbine is in turn transferred to the coolant, which is then removed from the blade, thereby cooling the blade.

13 Claims, 3 Drawing Sheets

FLUID-COOLED TURBINE BLADES

FIELD OF THE INVENTION

The present invention relates to the cooling of turbine rotor blades and stationary vanes (both of which are generically referred to herein as "turbine blades" unless otherwise indicated). The invention relates more particularly to cooling of turbine blades using a coolant supplied to internal passages in the blades.

BACKGROUND OF THE INVENTION

A turbine produces rotational power by receiving high-temperature, high-pressure gases such as combustion gases from a fuel combustor, and expanding the gases to a lower temperature and lower pressure via an alternating series of stationary vanes and rotating blades. A gas turbine may have a single "stage" consisting of a row of stationary vanes followed by a row of rotor blades, or it may have two or more such stages in series. In high-performance gas turbine engines, the temperature of the combustion gases entering the first stage of the turbine typically is so high that the available materials for constructing the stationary vanes and rotor blades are not capable of withstanding the extreme temperature without some type of active cooling of the blades and vanes. Thus, modern advances in gas turbine technology have largely been made through discoveries of improved materials capable of withstanding higher temperatures, coupled with improved cooling schemes.

The efficiency of gas turbines generally goes hand-in-hand with the turbine inlet temperature, such that higher turbine inlet temperatures provide higher efficiencies in general. These higher temperatures increase the challenge of cooling the blades and vanes adequately. Conversely, anything that reduces the effective temperature of the hot gases passing through the turbine without doing a corresponding amount of work results in a reduction in turbine efficiency. This leads to a tradeoff in conventional gas turbines because the blades are typically cooled by film cooling techniques. In film cooling, a cooling fluid (typically air in most gas turbines) is supplied through internal passages formed in the turbine blade and is ejected from the passages through holes in the outer surface of the blade, such that the cooling fluid flows over the outer surface to be cooled and forms a protective layer of fluid that is substantially cooler than the hot gases passing through the turbine, thus effectively insulating the blade surface against the hot gases. It is typical to have a relatively large number of film cooling holes around the leading edges of turbine blades, especially in the first stage or first few stages where the temperatures of the hot gases are greatest, and to have additional film cooling holes distributed over the suction-side and pressure-side surfaces of the blades, and perhaps film cooling slots in the trailing edges of some blades.

It will be appreciated that film cooling thus involves injecting cooling fluid in the main gas flow path of the turbine, which reduces the effective temperature of the gases passing through the turbine. This leads to a reduction in the efficiency of the turbine. In extreme cases, the total mass flow of cooling fluid ejected through film cooling holes may represent 20 percent of the mass flow of the hot gases, or more, leading to efficiency reductions of 10 percent or more.

Accordingly, it would be desirable to improve the cooling of turbine blades, enabling higher turbine inlet temperatures and correspondingly improved turbine efficiencies for a given type of blade material.

SUMMARY OF THE INVENTION

The present invention addresses the above needs and achieves other advantages, by providing a cooled turbine blade (either a rotor blade or a stationary vane) that comprises a blade structural member whose primary function is to withstand the various loads exerted on the blade and maintain structural integrity of the blade, and a heat-transfer sheath that surrounds the outer surface of the structural member. A plurality of coolant passages are formed between the structural member and the heat-transfer sheath. Thus, when coolant is passed through the coolant passages, the heat transferred to the sheath from the hot gases is in turn transferred to the coolant, which is then removed from the blade, thus cooling the blade.

In preferred embodiments of the invention, the coolant passages are closed, such that they do not emit any coolant into the main gas flow path of the turbine. In these embodiments, the coolant passages in the blade are in fluid communication with coolant supply and exhaust manifolds formed, for example, in the disk supporting a rotor blade or in one of the shrouds of a stationary vane. Each coolant passage is a closed loop such that all coolant that flows through the passage into the blade subsequently flows back out of the blade and is recovered, with the possible exception of very small amounts of coolant leakage that may occur, for example, at sealed connections between a rotor blade and its disk or between a stationary vane shroud and the casing in which it is mounted. Thus, substantially no coolant is dumped into the main gas flow path of the turbine, thereby improving potential turbine efficiency.

The coolant passages can be formed in the outer surface of the blade structural member, such as by machining the outer surface. Alternatively, the channels can be machined or otherwise formed in the inner surface of the sheath. Conveniently, the passages can be machined as channels of rectangular or square cross-section; bonding the heat-transfer sheath onto the outer surface of the structural member then closes the channels to form closed passages.

In preferred embodiments of the invention, the coolant supplied to the coolant passages comprises liquid water. As the water flows through the passages, heat transfer into the water from the sheath causes steam to be formed. The coolant may exit the passages primarily in the form of saturated steam. In order to maintain the walls of the passages bathed with liquid water as much as possible so that the desired high heat transfer rate into the coolant is maintained, it is preferred to size the passages so that surface tension of the water keeps the water adhered to the passage walls. This can be accomplished by configuring each passage in cross-section as a parallelepiped (e.g., a rectangle or square) each edge of which is about 0.5 to 1.3 mm (0.02 to 0.05 inch) in length.

The heat-transfer sheath can comprise various materials preferably of high thermal conductivity. Examples of suitable materials include but are not limited to copper, nickel, alloys such as Narloy-Z (a high-strength copper alloy). The sheath can be attached to the blade structural member in various ways, with diffusion bonding being the preferred technique. The sheath preferably is formed in multiple separate pieces that collectively cover the structural member. The sheath preferably is relatively thin, for example, about 1 to 2 mm (0.04 to 0.08 inch).

The invention also may enable damping of blade vibrations to be accomplished by fluid damping from the coolant in the internal coolant passages, as opposed to the use of external damping devices often used in conventional turbines. More particularly, frictional damping devices that rub against adjacent surfaces during blade vibrations are frequently used in conventional turbines in order to reduce the magnitude of blade vibrations to acceptable levels so that the blades have adequate fatigue life. Frictional dampers, being external to the blades, tend to disturb the blade aerodynamics, which leads to reduced turbine efficiency. Such dampers also are subject to wear that can reduce their effectiveness and eventually may necessitate their replacement. Frictional dampers also represent additional parts that must be manufactured, inventoried, installed, monitored, and replaced when needed. If a damper should fail and break loose during turbine operation, it could cause damage to the turbine and/or to components downstream of the turbine.

In contrast, the fluid damping provided by the coolant, such as liquid water, flowing through the coolant passages between the sheath and blade structural member of the present invention requires no extra parts and hence no additional cost, does not disturb the blade aerodynamics, and does not employ components that could break loose and cause damage. The fluid damping is essentially out of phase with primary bending and shear stresses in the blade, such that the damping can reduce internal shear forces and deflections.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
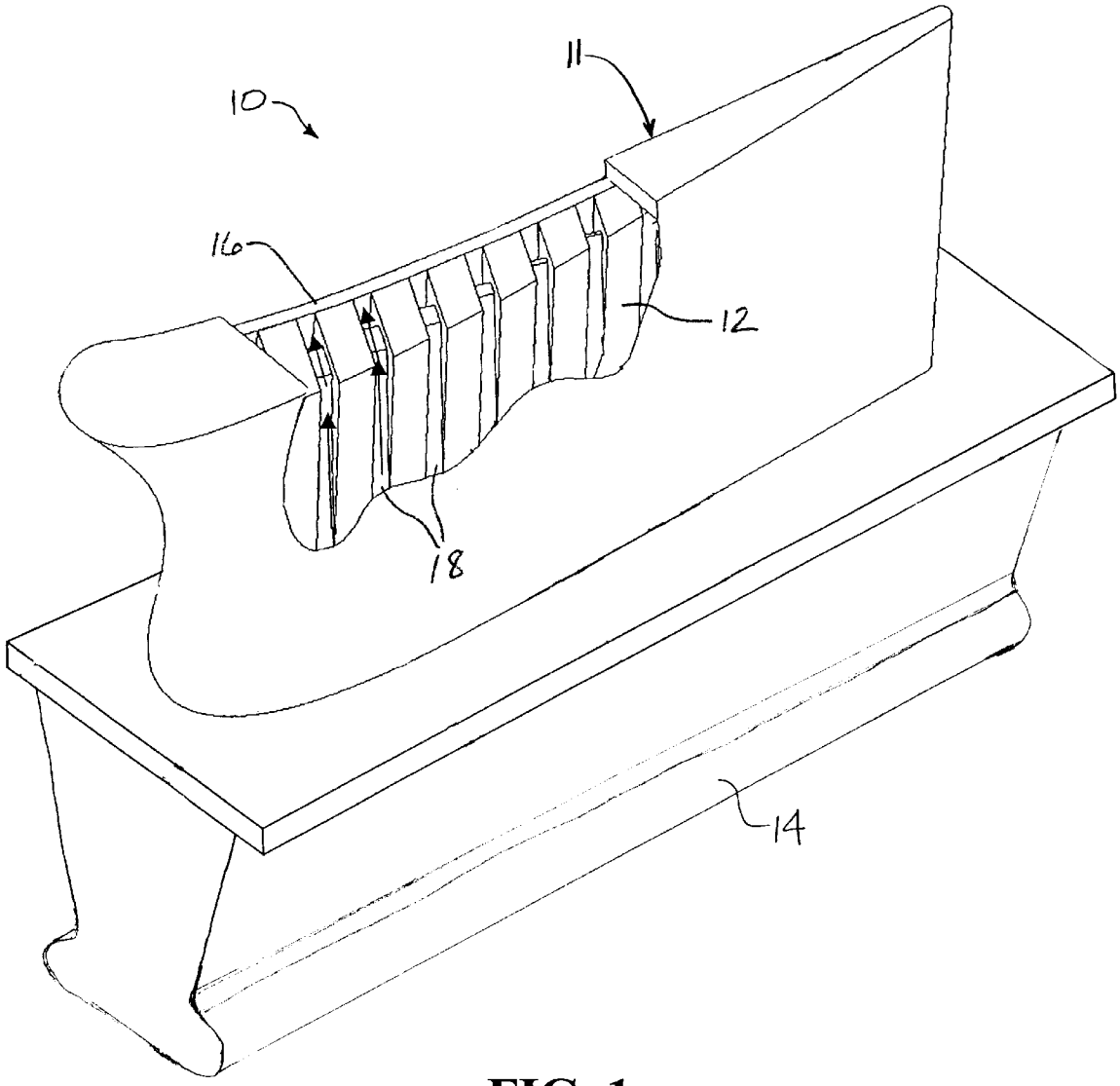
FIG. 1 is a schematic perspective view of a turbine rotor blade in accordance with one preferred embodiment of the invention.

With reference to FIG. 1, a turbine rotor blade 10 in accordance with one preferred embodiment of the invention is shown in schematic representation. The blade includes a blade airfoil portion 11 and a blade root portion 14. The blade airfoil portion comprises a structural member 12 that substantially defines the airfoil shape of the blade, and whose primary function is to withstand the various loads exerted on the blade during use and to maintain structural integrity of the blade. The structural member is accordingly formed of any of various conventional materials used for forming turbine rotor blades, including but not limited to nickel-based superalloys and others. The inner end of the structural member 12 is attached to the blade root 14 that serves to affix the rotor blade in a turbine disk. The blade root 14 and the structural member 12 can comprise a monolithic structure formed from a single piece of material, or can comprise two separately formed members that are subsequently joined.

The rotor blade airfoil portion also includes a heat-transfer sheath 16 that surrounds and is bonded to the structural member 12. The heat-transfer sheath 16 comprises a material preferably having a substantially higher thermal conductivity than that of the structural member 12. Various materials are suitable for the heat-transfer sheath, including but not limited to copper-based alloys such as Narloy-Z, nickel-based alloys, and others. The selection of an appropriate material for the sheath will generally depend on various factors such as the operating environment in which the rotor blade will operate, the degree of heat transfer needed in order to effectively cool the blade, the stresses (both mechanical and thermal) that will be placed on the sheath in use, and others.

The sheath 16 preferably is diffusion-bonded or brazed to the structural member 12. Diffusion-bonding is a process in which two metal members, typically of dissimilar metals, are pressed together with high pressure under high temperature to cause the interface surfaces of the members to diffuse into each other, thus bonding the members together. Diffusion bonding is known to those skilled in the art, and hence is not further described herein.

The blade includes a plurality of passages or channels 18 between the heat-transfer sheath 16 and the structural member 12 for the passage of coolant to cool the blade. The coolant passages 18 in the embodiment of FIG. 1 comprise channels machined into or otherwise formed in the outer surface of the structural member 12. Alternatively, the channels can be machined into or otherwise formed in the inner surface of the heat-transfer sheath 16. The channels extend along one surface (e.g., the convex or suction-side surface) of the structural member from the inner end toward the outer end thereof, and then back along the other surface (e.g., the concave or pressure-side surface) of the structural member to the inner end thereof. When the sheath is bonded to the structural member, coolant passages 18 are thereby formed between them. The coolant passages thus run just beneath the external surface of the rotor blade 10. Heat is transferred from the hot gases in the main turbine flow path to the sheath 16, which in turn transfers heat to the coolant flowing in the passages 18. The coolant is removed from the blade to cool the blade.

Figure 2:
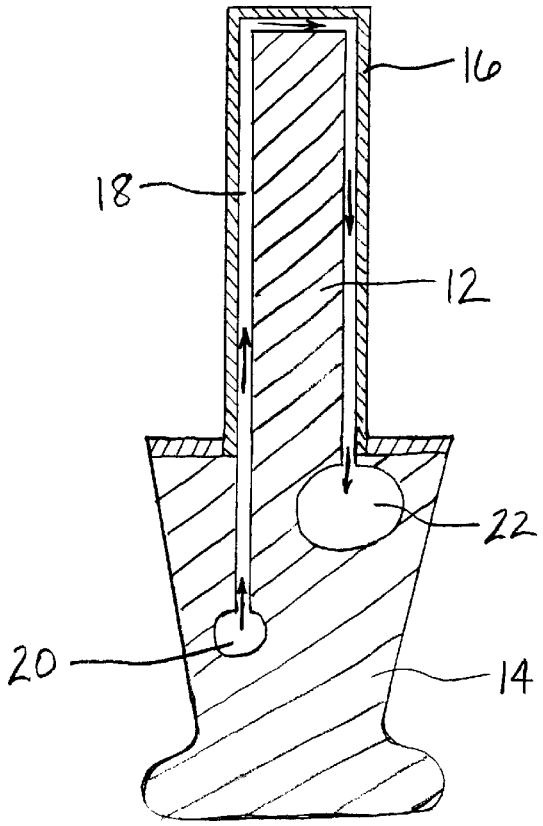
FIG. 2 is a schematic cross-sectional view of a blade in accordance with the invention.
Figure 3:
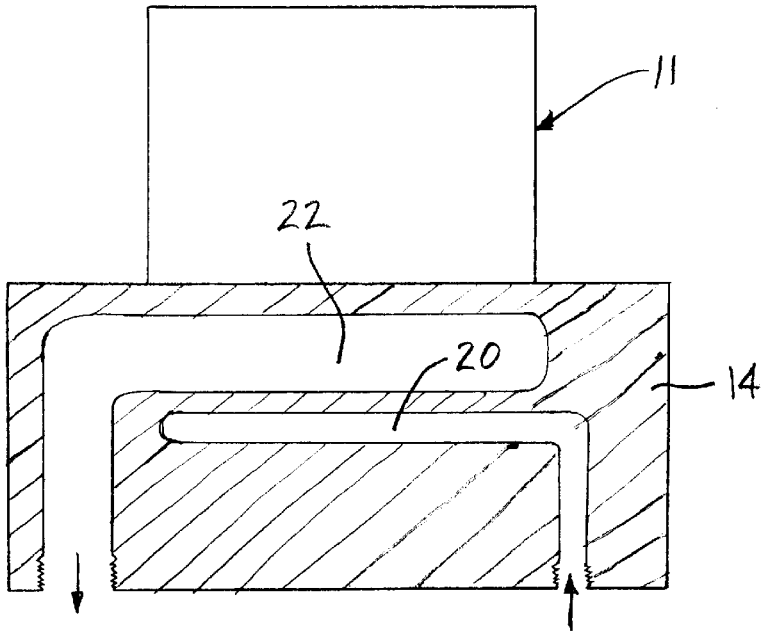
FIG. 3 is a schematic side view of a blade in accordance with the invention, with the blade root sectioned to show the coolant manifolds.

FIG. 2 shows a cross-sectional view of a blade in accordance with the invention along a plane generally parallel to the blade axis, which typically extends generally radially with respect to a turbine disk in which the blade is installed. FIG. 3 is a cross-section on a plane parallel to the blade axis and perpendicular to the plane of FIG. 2. As shown, each coolant passage 18 is fed coolant from a coolant supply manifold 20 formed in the blade root 14. Although not illustrated, the coolant supply manifold 20 would be connected with a further coolant supply duct in the turbine, which duct may be formed in the turbine disk, for example. Suitable sealing mechanisms (not shown) would seal the interfaces between the coolant supply manifolds in the blades and the corresponding supply ducts in the disk or other structure of the turbine.

Coolant, which for instance may comprise liquid water, flows from the coolant supply manifold 20 radially outwardly along each of the coolant passages 18 and then flows radially inwardly along the passages 18. As the liquid water traverses the passages, it will be heated and converted to steam. The heated coolant flows back into the blade root into a coolant exhaust manifold 22 formed therein. The coolant exhaust manifold would be connected to a coolant exhaust duct provided, for example, in the turbine disk, and sealed to the duct with suitable sealing mechanisms. Since the exhausted coolant typically may contain a substantial fraction of steam whereas the supplied coolant is liquid water, the exhaust manifold 22 has a larger cross-sectional flow area relative to the supply manifold 20, as shown.

The sizing of the coolant passages 18 in the blade is an important consideration. When liquid water is used as the coolant, as noted above, the water will be converted to steam as it progresses along a passage. It is important to prevent film boiling along the walls of the passage, or else the heat transfer rate from the sheath 16 into the coolant will be severely reduced, leading to possible blade damage or failure. Accordingly, the walls of the passage should be bathed in liquid water to as great an extent as possible. In order to accomplish this, the passages are sized to utilize the surface tension of the water to keep liquid water adhered to the walls of the passages.

Figure 4:
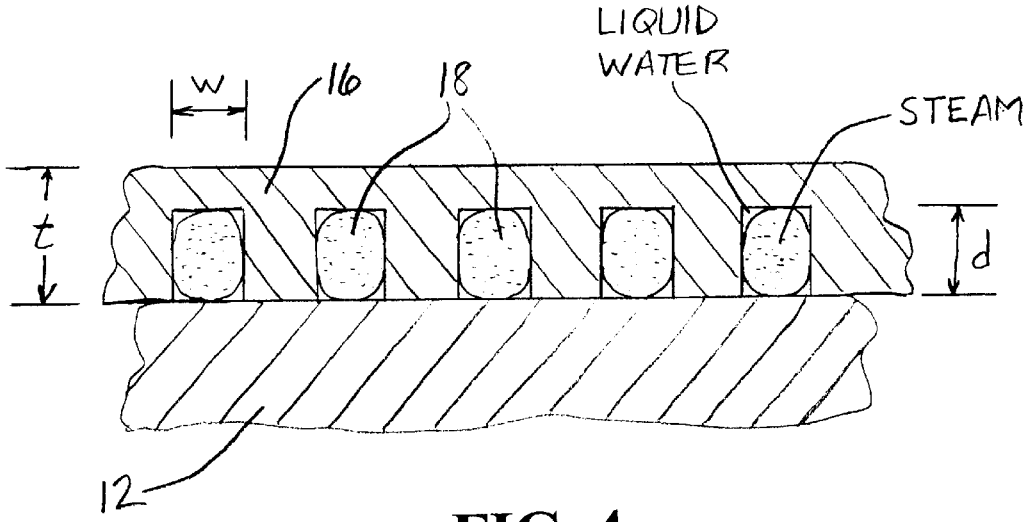
FIG. 4 is a schematic cross-sectional view of a blade showing several coolant passages in accordance with the invention.

With reference to FIG. 4, which shows an alternative embodiment in which the passages 18 are formed in the sheath rather than in the blade structural member, preferably each passage 18 is formed in cross-section generally as a quadrilateral with a depth d of about 0.5 to 1.3 mm (0.02 to 0.05 inch) and with a width w of about 0.5 to 1.3 mm (0.02 to 0.05 inch). Surface tension of the water tends to keep water adhered to the walls in the corners of the passage, and since the dimensions along the sides of the passage are small, the water adhered in the corners tends to extend some distance out from the corners along the passage wall surfaces. Thus, as the liquid water is converted to steam, the steam tends to migrate to the center of the passage and liquid water tends to remain on the walls of the passage, thereby preventing any substantial amount of film boiling along the walls.

The thickness t of the heat-transfer sheath 16 preferably is relatively small, for example, about 1 to 2 mm (0.04 to 0.08 inch). It will be understood that when the passages are formed in the sheath as in FIG. 4, the sheath thickness t, the passage dimensions d, w, and the spacing between passages must be chosen so that there is an adequate thickness of sheath material on all sides of each passage to withstand the mechanical and thermal stresses exerted on the sheath and to have adequate fatigue life.

Although the particular embodiments shown and described above relate to turbine rotor blades, it will be appreciated that the invention is not limited to rotor blades, but applies to stationary vanes as well. A stationary vane typically includes an inner shroud attached to a radially inner end of the vane airfoil section, and an outer shroud attached to a radially outer end of the airfoil section. The outer shrouds of the vanes are mounted in a turbine outer casing. In accordance with the invention, coolant supply and exhaust manifolds can be formed in the outer shroud or in the inner shroud. It is also possible to form the supply manifold in one of the shrouds and the exhaust manifold in the other shroud.

Figure 5:
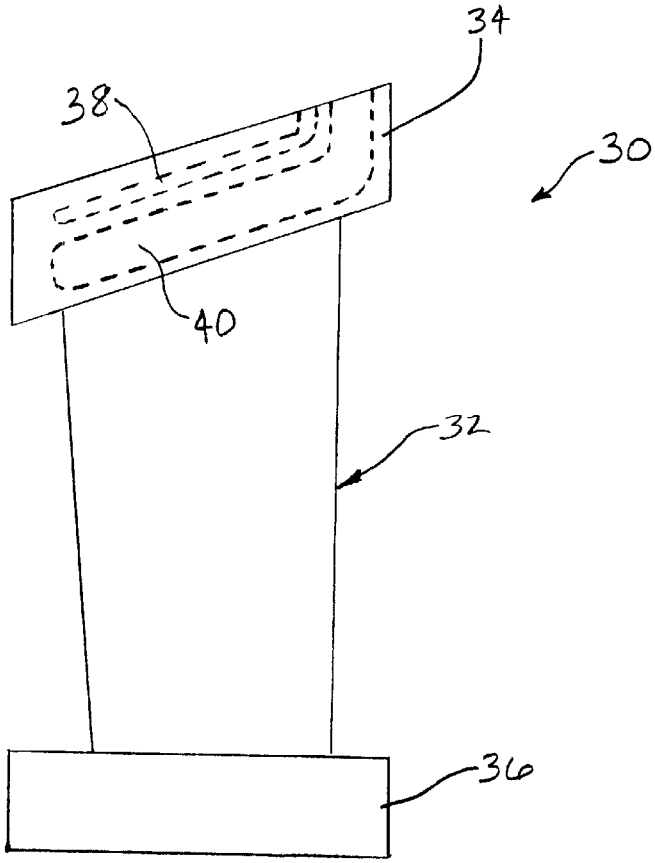
FIG. 5 is a schematic depiction of a stationary vane in accordance with the invention.

For instance, FIG. 5 shows a highly schematic rendering of a turbine vane 30 in accordance with the invention. The vane includes an airfoil section 32 having a construction similar to the airfoil section of the rotor blade previously described (i.e., having a structural member and a heat-transfer sheath, not shown). The outer end of the vane airfoil section is attached to an outer shroud 34 and the inner end of the airfoil section is attached to an inner shroud 36. The passages (not shown) beneath the outer surface of the vane airfoil section are connected to a coolant supply manifold 38 and a coolant exhaust manifold 40 formed in the outer shroud.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cooled blade for a turbine, comprising:

a blade structural member extending along a blade longitudinal axis from an inner end to an outer end of the structural member and having a generally airfoil-shaped cross-section normal to the longitudinal axis;

a heat-transfer sheath surrounding and bonded to an outer surface of the structural member, the heat-transfer sheath defining an external aerodynamic surface of the blade; and coolant passages defined between the heat-transfer sheath and the structural member, whereby coolant passed through the coolant passages extracts heat from the heat-transfer sheath to cool the blade, each coolant passage forming a closed cooling circuit separate from the other coolant passages, each coolant passage entering one end of the blade and extending toward the opposite end of the blade and then back out the one end of the blade such that all coolant in each coolant passage is recovered, whereby the blade is cooled without dumping coolant into a main gas flow path of the turbine.

2. The cooled turbine blade of claim 1, wherein the structural member is formed of a first material and the heat-transfer sheath is formed of a second material having a greater thermal conductivity than that of the first material.

3. The cooled turbine blade of claim 1, wherein the coolant passages are formed as grooves in an inner surface of the heat-transfer sheath that is bonded to the outer surface of the structural member.

4. The cooled turbine blade of claim 1, wherein the coolant passages are formed as grooves in the outer surface of the structural member that is bonded to an inner surface of the heat-transfer sheath.

5. The cooled turbine blade of claim 1, wherein each coolant passage extends along both pressure- and suction-sides of the blade.

6. The cooled turbine blade of claim 1, wherein the blade comprises a rotor blade.

7. The cooled turbine blade of claim 1, wherein the blade comprises a stationary vane.

8. The cooled turbine blade of claim 1, wherein the heat-transfer sheath is diffusion-bonded or brazed to the structural member.

9. The cooled turbine blade of claim 1, wherein a cross-section of each coolant passage comprises a quadrilateral each edge of which is about 0.02–0.05 inch in length.

10. The cooled turbine blade of claim 1, wherein the heat-transfer sheath comprises copper.

11. The cooled turbine blade of claim 1, wherein the heat-transfer sheath comprises nickel.

12. The cooled turbine blade of claim 1, wherein the blade comprises a rotor blade having a blade root attached to the blade structural member, and wherein a coolant supply manifold and a coolant exhaust manifold are formed in the blade root, the coolant passages receiving coolant from the supply manifold and discharging coolant into the exhaust manifold.

13. The cooled turbine blade of claim 1, wherein the blade comprises a stationary vane having an outer shroud and an inner shroud, and wherein a coolant supply manifold and a coolant exhaust manifold are formed in one of the shrouds, the coolant passages receiving coolant from the supply manifold and discharging coolant into the exhaust manifold.

* * * * *